US008162529B2

(12) United States Patent
Khouri et al.

(10) Patent No.: US 8,162,529 B2
(45) Date of Patent: Apr. 24, 2012

(54) MIXING DRUM

(75) Inventors: Anthony J. Khouri, Sydney (AU); William Rodgers, Sydney (AU); William Tippins, Muscle Shoals, AL (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 948 days.

(21) Appl. No.: 10/591,113

(22) PCT Filed: Jun. 29, 2004

(86) PCT No.: PCT/US2004/021061

§ 371 (c)(1),
(2), (4) Date: Mar. 11, 2008

(87) PCT Pub. No.: WO2005/095073

PCT Pub. Date: Oct. 13, 2005

(65) Prior Publication Data

US 2008/0291771 A1 Nov. 27, 2008

Related U.S. Application Data

(60) Provisional application No. 60/550,190, filed on Mar. 4, 2004.

(51) Int. Cl.

| | |
|---|---|
| ***B28C 5/18*** | (2006.01) |
| ***B28C 7/16*** | (2006.01) |
| ***B01F 9/00*** | (2006.01) |

(52) U.S. Cl. ..... 366/59; 366/44; 366/57; 366/227

(58) Field of Classification Search ..... 366/92, 366/59, 44, 57, 227

See application file for complete search history.

(56) References Cited

U.S. PATENT DOCUMENTS

| | | | |
|---|---|---|---|
| 1,501,566 | A | 7/1924 | Lundberg |
| 1,781,965 | A | 11/1930 | Ball |
| 1,983,891 | A | 12/1934 | Ball |
| 1,987,894 | A | 1/1935 | Eggert |
| 2,054,469 | A | 9/1936 | Rybeck |
| 2,073,652 | A | 3/1937 | Robb |
| 2,109,534 | A | 3/1938 | Johnson |
| 2,174,089 | A | 9/1939 | Johnson |
| 2,199,289 | A | 4/1940 | Johnson |
| 2,238,343 | A | 4/1941 | Rybeck et al. |
| 2,303,902 | A | 12/1942 | Ball |
| 2,352,202 | A | 6/1944 | Johnson |
| 2,408,397 | A | 10/1946 | Johnson |
| 2,437,302 | A | 3/1948 | Maxon, Jr. |

(Continued)

FOREIGN PATENT DOCUMENTS

| | | | |
|---|---|---|---|
| CN | 1132486 | A | 10/1996 |

(Continued)

OTHER PUBLICATIONS

International Search Report for International Application No. PCT/AU00/01226, date mailed Dec. 6, 2000, 2 pages.

(Continued)

*Primary Examiner* — Nathan Bowers
*Assistant Examiner* — Gautam Prakash
(74) *Attorney, Agent, or Firm* — Foley & Lardner LLP

(57) ABSTRACT

A rotary concrete mixing drum (16) includes an interior surface (74) at least partially provided by a polymer (90) impregnated with a slip agent.

19 Claims, 6 Drawing Sheets

U.S. PATENT DOCUMENTS

| | | | |
|---|---|---|---|
| 2,511,240 | A | 6/1950 | Bohmer et al. |
| 2,696,372 | A | 12/1954 | Gerst |
| 3,080,152 | A | 3/1963 | Lendved |
| 3,144,242 | A | 8/1964 | Retzlaff |
| 3,165,789 | A | 1/1965 | Jackson |
| 3,317,194 | A | 5/1967 | Heltzel |
| 3,549,077 | A | 12/1970 | Huck |
| 3,592,448 | A | 7/1971 | Stevenson |
| 3,641,730 | A | 2/1972 | Meckstroth |
| 3,664,161 | A | 5/1972 | Cressman |
| 3,700,512 | A | 10/1972 | Pearson et al. |
| 3,717,328 | A | 2/1973 | Stevenson |
| 3,717,916 | A | 2/1973 | Wienand et al. |
| 3,795,121 | A | 3/1974 | Cressman |
| 3,795,364 | A | 3/1974 | Kattner |
| 3,830,899 | A | 8/1974 | Piccioli et al. |
| 3,888,468 | A | 6/1975 | Albin |
| 3,929,321 | A | 12/1975 | Sims |
| 4,064,956 | A | 12/1977 | Wildey |
| 4,086,378 | A | 4/1978 | Kam et al. |
| 4,124,304 | A | 11/1978 | Suganuma |
| 4,137,950 | A | 2/1979 | Briscall |
| 4,223,997 | A | 9/1980 | Violet et al. |
| 4,309,511 | A | 1/1982 | Jefferson et al. |
| 4,363,687 | A | 12/1982 | Anderson |
| 4,366,919 | A | 1/1983 | Anderson |
| 4,391,108 | A | 7/1983 | Albers |
| 4,435,082 | A | 3/1984 | Bishop |
| 4,491,415 | A | 1/1985 | Bishop |
| 4,521,116 | A | 6/1985 | Adsit |
| 4,525,228 | A | 6/1985 | Bowen |
| 4,569,648 | A | 2/1986 | Riederer et al. |
| 4,585,356 | A | 4/1986 | Hudelmaier |
| 4,634,284 | A | 1/1987 | Bishop |
| 4,655,602 | A | 4/1987 | Tomlinson |
| 4,690,306 | A | 9/1987 | Staheli |
| 4,690,988 | A | 9/1987 | Hoffman et al. |
| 4,730,934 | A | 3/1988 | Schwing |
| 4,750,840 | A | 6/1988 | Bishop |
| 4,756,623 | A | 7/1988 | Bishop |
| 4,792,234 | A | 12/1988 | Doherty |
| 4,822,272 | A | 4/1989 | Yanase et al. |
| 4,877,327 | A | 10/1989 | Whiteman, Jr. |
| 4,937,010 | A | 6/1990 | Maillat |
| 5,056,924 | A | 10/1991 | Christenson |
| 5,118,198 | A | 6/1992 | Whiteman, Jr. |
| 5,178,457 | A | 1/1993 | Helmy |
| RE34,505 | E | 1/1994 | Whiteman, Jr. |
| 5,302,017 | A | 4/1994 | Platek et al. |
| 5,326,795 | A | 7/1994 | Wykowski |
| 5,348,387 | A | 9/1994 | Gordon et al. |
| 5,378,061 | A | 1/1995 | Christenson |
| 5,383,581 | A | 1/1995 | LeMarbe et al. |
| 5,388,767 | A | 2/1995 | Moses |
| 5,388,768 | A | 2/1995 | Moses |
| 5,399,192 | A | 3/1995 | Yamasoe |
| 5,411,329 | A | 5/1995 | Perry |
| 5,427,449 | A | 6/1995 | Christenson et al. |
| 5,429,308 | A | 7/1995 | Brown |
| 5,432,211 | A | 7/1995 | Morita et al. |
| 5,441,341 | A | 8/1995 | Halsted |
| 5,460,675 | A | 10/1995 | Moser |
| 5,474,379 | A | 12/1995 | Perry |
| 5,487,604 | A | 1/1996 | Moran |
| 5,492,401 | A | 2/1996 | Halsted |
| 5,570,822 | A | 11/1996 | LeMarbe et al. |
| 5,667,298 | A | 9/1997 | Musil et al. |
| 5,683,177 | A | 11/1997 | Hoferichter et al. |
| 5,739,240 | A | 4/1998 | Smith |
| 5,772,938 | A | 6/1998 | Sharp |
| 5,773,531 | A | 6/1998 | Smith |
| 5,816,702 | A | 10/1998 | Mays et al. |
| 5,839,924 | A | 11/1998 | Ritson |
| 5,908,913 | A | 6/1999 | Orthmann et al. |
| 5,979,794 | A | 11/1999 | DeFillipi et al. |
| 6,021,961 | A | 2/2000 | Brown |
| H1872 | H | 10/2000 | Bowman |
| 6,277,939 | B1 | 8/2001 | Smith |
| 6,329,475 | B1 | 12/2001 | Kelly |
| 6,388,023 | B1 | 5/2002 | Hsu et al. |
| 6,472,069 | B1 | 10/2002 | Bailey et al. |
| 6,500,911 | B1 | 12/2002 | Endo et al. |
| 6,527,203 | B2 | 3/2003 | Hurray et al. |
| 6,583,218 | B1 | 6/2003 | Airola et al. |
| 6,617,417 | B1 | 9/2003 | Airola et al. |
| 6,660,373 | B2 | 12/2003 | Hsu et al. |
| 6,663,021 | B1 | 12/2003 | Scarpa et al. |
| 6,705,538 | B2 | 3/2004 | Fecht et al. |
| 6,800,170 | B2 | 10/2004 | Kendall et al. |
| 6,815,499 | B2 | 11/2004 | Yasumura et al. |
| 6,830,804 | B2 | 12/2004 | Hsu et al. |
| 6,872,337 | B2 | 3/2005 | Mellentine et al. |
| 6,902,311 | B1 | 6/2005 | Khouri et al. |
| 6,938,799 | B1 | 9/2005 | Berntsen et al. |
| 6,951,909 | B2 | 10/2005 | Deviny et al. |
| 7,678,317 | B2 | 3/2010 | Khouri et al. |
| 2002/0022695 | A1 | 2/2002 | Ueno et al. |
| 2002/0071336 | A1* | 6/2002 | Smith et al. ..... 366/59 |
| 2002/0072574 | A1 | 6/2002 | Hsu et al. |
| 2003/0105177 | A1 | 6/2003 | Parfondry et al. |
| 2005/0042976 | A1* | 2/2005 | Ronay ..... 451/41 |
| 2006/0152997 | A1 | 7/2006 | Khouri et al. |
| 2006/0167140 | A1 | 7/2006 | Altounian et al. |
| 2007/0159915 | A1 | 7/2007 | Daly et al. |
| 2007/0187434 | A1 | 8/2007 | Schrafel |
| 2007/0189110 | A1 | 8/2007 | Khouri |
| 2008/0225632 | A1 | 9/2008 | Khouri |
| 2008/0259715 | A1 | 10/2008 | Harris et al. |
| 2008/0259716 | A1 | 10/2008 | Khouri |
| 2008/0279035 | A1 | 11/2008 | Altounian |

FOREIGN PATENT DOCUMENTS

| | | | |
|---|---|---|---|
| DE | 88 01 881 | U1 | 4/1988 |
| DE | 40 10 539 | A1 | 10/1991 |
| EP | 0438852 | B1 | 1/1996 |
| EP | 0696422 | B1 | 6/1999 |
| EP | 0 998 383 | B1 | 5/2000 |
| EP | 1238904 | A2 | 9/2002 |
| GB | 2 032 793 | A | 5/1980 |
| GB | 2 274 404 | A | 7/1994 |
| IL | 148560 | | 6/2007 |
| JP | 53-088261 | | 8/1978 |
| JP | 8-114096 | A | 5/1996 |
| JP | 8-199052 | A | 8/1996 |
| JP | 11-134001 | A | 5/1999 |
| RU | 2 052 350 | C1 | 1/1996 |
| WO | WO 97/32702 | A1 | 9/1997 |
| WO | WO 00/64651 | | 11/2000 |
| WO | WO 01/26871 | A1 | 4/2001 |
| WO | WO 03/101674 | A1 | 12/2003 |
| WO | WO 03/101694 | A1 | 12/2003 |
| WO | WO 2005/018894 | A1 | 3/2005 |
| WO | WO 2005/018895 | A1 | 3/2005 |
| WO | WO 2005/018897 | A1 | 3/2005 |
| WO | WO 2005/018898 | A1 | 3/2005 |
| WO | WO 2005/018899 | A1 | 3/2005 |
| WO | WO 2005/025438 | A1 | 3/2005 |
| WO | WO 2005/025657 | A1 | 3/2005 |
| WO | WO 2005/095073 | A1 | 10/2005 |
| WO | WO 2005/113211 | A1 | 12/2005 |
| WO | WO 2006/005205 | A1 | 1/2006 |
| WO | WO 2006/069285 | A2 | 6/2006 |
| WO | WO 2007/061736 | A2 | 5/2007 |
| WO | WO 2007/094930 | A1 | 8/2007 |

OTHER PUBLICATIONS

International Search Report and Written Opinion for International Application PCT/US04/21061, mail date Nov. 29, 2004, 4 pages.

Notice of Allowance for U.S. Appl. No. 10/516,726, date mailed Apr. 23, 2010, 6 pages.

Notice of Allowance for U.S. Appl. No. 10/516,726, date mailed Jan. 13, 2010, 5 pages.

Office Action for U.S. Appl. No. 10/516,726, date mailed Mar. 24, 2009, 8 pages.

Office Action for U.S. Appl. No. 10/516,726, date mailed Oct. 8, 2009, 7 pages.

Office Action for U.S. Appl. No. 10/568,304, date mailed Mar. 1, 2010, 11 pages.
Response to Office Action for U.S. Appl. No. 10/516,726, filed Jan. 8, 2010, 7 pages.
Response to Office Action for U.S. Appl. No. 10/516,726, filed Jun. 24, 2009, 25 pages.
Supplementary European Search Report relating to Application No. EP 03 81 8335, date of completion of the search Nov. 26, 2008, 2 pages.
Supplementary European Search Report relating to Application No. EP 03 81 8344, date of completion of the search Nov. 26, 2008, 2 pages.
Supplementary European Search Report relating to Application No. EP 03 81 8345, date of completion of the search Nov. 26, 2008, 2 pages.
Supplementary European Search Report relating to Application No. EP 04 77 7337, date of completion of the search Nov. 27, 2008, 2 pages.
Supplementary European Search Report for PCT/AU0300664, date of mailing Jan. 8, 2008, 2 pages.
International Search Report for PCT/US04/21061, date of mailing Nov. 29, 2004, 1 page.

* cited by examiner

MIXING DRUM

The present application claims priority under 35 U.S.C. §119(e) from U.S. Provisional Patent Application Ser. No. 60/550,190, filed on Mar. 4, 2004 by William D. Tippins, Anthony J. Khouri and William Rodgers, and entitled MIXING DRUM, the full disclosure of which is hereby incorporated by reference.

BACKGROUND

Front discharge concrete mixing drums generally extend above a cab of a vehicle and discharge concrete at a front of a vehicle. Because such drums must extend over and above the cab, front discharge drums are extremely long, typically requiring extra sections which must be bolted together. This extra length subjects portions of the drum to greater stresses and creates additional seams where concrete can collect. As a result, cleaning of the front discharge drum is even more tedious and time consuming as compared to cleaning the interior of rear discharge drums. In addition to collecting on the interior of the concrete mixing drum, concrete also frequently collects on the exterior of the drum. Collection of concrete on the exterior of the drum further increases the time and cost of cleaning the drum.

BRIEF DESCRIPTION OF THE DRAWINGS

FIG. 4 is an enlarged fragmentary sectional view of a barrel of the drum of FIG. 1.

DESCRIPTION

Figure 1:
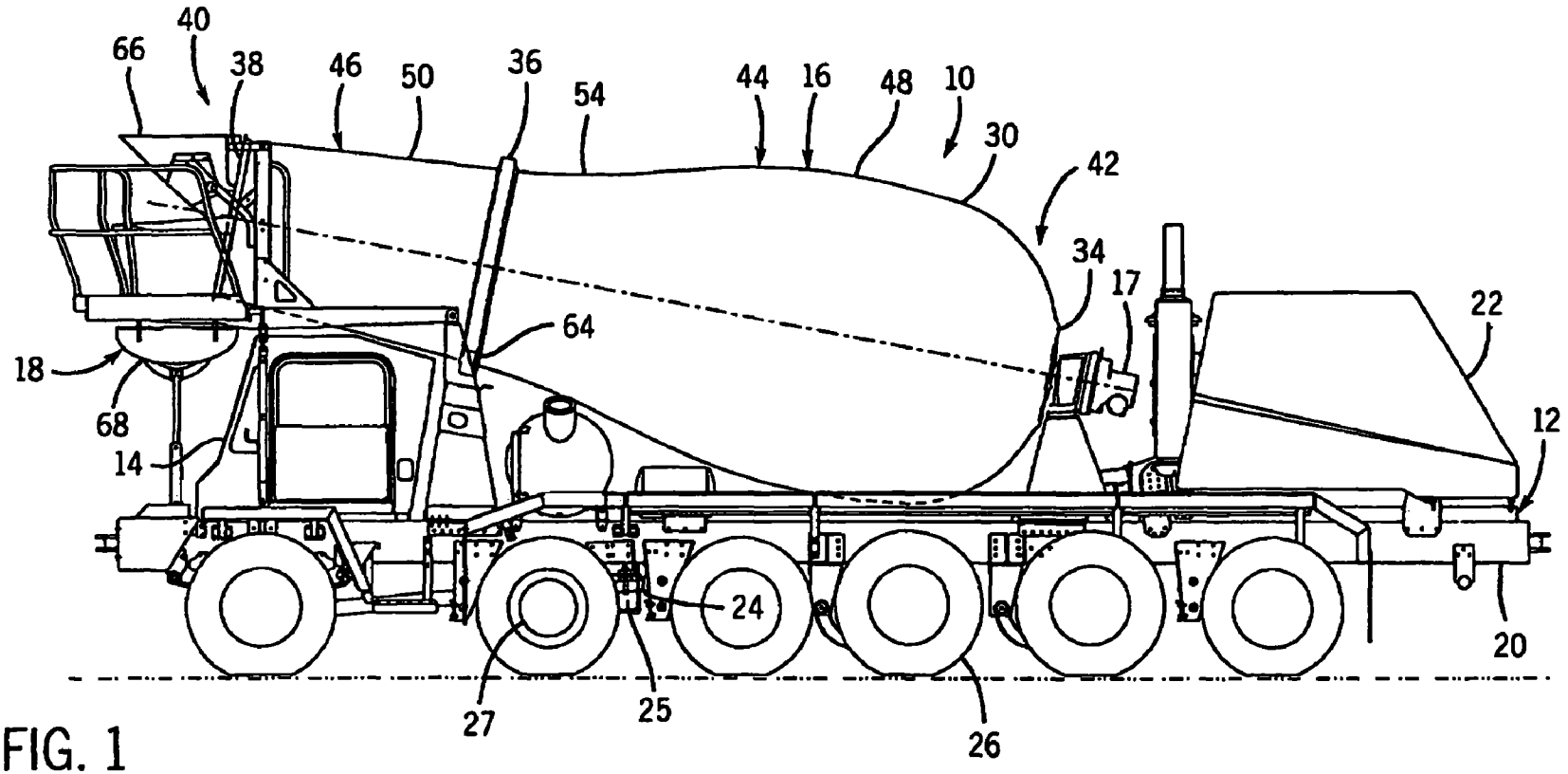
FIG. 1 is a side elevational view of a concrete mixing vehicle having a mixing drum according to one exemplary embodiment.

FIG. 1 is a side elevational view of a concrete mixing truck 10 which generally includes chassis 12, cab 14, drum 16, mixing drum and drum drive 17, and delivery system 18. Chassis 12 generally supports and power the remaining components of truck 10 and generally includes frame 20, power source 22, drivetrain 24 and wheels 26. Frame 20 provides mixing truck 10 with the structural support and rigidity needed to carry heavy loads of concrete. Power source 22 is coupled to frame 20 and generally comprises a source of rotational mechanical energy which is derived from a stored energy source. Examples include, but are not limited to, an internal combustion gas-powered engine, a diesel engine, turbines, fuel cell driven motors, an electric motor or any other type of motor capable of providing mechanical energy.

For purposes of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Drivetrain 24 is coupled between power source 22 and wheels 26 and transfers power (or movement) from power source 22 to wheels 26 to propel truck 10 in a forward or rearward direction. Drivetrain 24 includes a transmission 25 and a wheel end reduction unit 27. Both transmission 25 and wheel end reduction unit 27 utilize a series or set of gears to adjust the torque transmitted by power source 22 to wheels 26. One example of a wheel end reduction unit is described in copending U.S. patent application Ser. No. 09/635,579, filed on Aug. 9, 2000, by Brian K. Anderson entitled NON-CONTACT SPRING GUIDE, the full disclosure of which is hereby incorporated by reference.

Cab 14 is coupled to chassis 12 and includes an enclosed area from which an operator of truck 10 drives and controls at least some of the various functions of truck 10.

Drive assembly or drivetrain 18 is operatively coupled to power source 22 and mixing drum 16 and uses the power or movement from power source 22 to provide a rotational force or torque to mixing drum 16. According to an alternative embodiment, the drivetrain may be powered by a source other than power source 22 that is provided on truck 10.

Mixing drum 16 contains concrete or other material mixed by truck 10. Mixing drum 16 includes barrel 30, projections 32 (shown in FIG. 2), drive ring 34, roller ring 36 and a hatch cover assembly (not shown). Barrel 30 is an elongate container having an opening 38 at a first axial end 40 and drive ring 34 coupled to an opposite axial end 42. Barrel 30 includes a main tear-drop or pear-shaped portion 44 and a frusto conical funnel-shaped snout portion 46. Main portion 44 provides a majority of interior volume of barrel 30 and has a generally convex exterior surface 48. Snout portion 46 has a generally linear tapered surface 50. Surfaces 48 and 50 merge together at a concave intermediate portion 54. As shown by FIG. 1, snout portion 46 extends from main portion 44 over and above cab 14 generally terminates at opening 38. Opening 38 communicates with the interior of drum 16 which has overall interior surface 56 (shown in FIG. 2) provided by an interior surface 58 of barrel 30 and an exterior surface of projections 32 (shown on FIGS. 2 and 3). As will be described in greater detail hereafter, the interior surface 56 of drum 16, and more particularly, interior surface 58 of barrel 30 and the exterior surface 60 of projections 32 are configured to inhibit adherence of concrete and other aggregate to such surfaces. Exterior surfaces 48 and 50 of barrel 30 are also configured to provide a smooth surface which inhibits collection of concrete and other aggregate.

Projections 32 (shown on FIG. 2) spirally extend within the interior of barrel 30 and project from interior surface 58 of barrel 30. Projections 32 (also known as fins, blades, veins, screws or formations) are specifically configured to move concrete and aggregate within barrel 30 towards opening 38 when drum 16 is rotated in the first direction. Conversely, projections 32 are configured to move concrete and aggregate towards end 42 to mix the concrete when drum 16 is rotated in a second opposite direction.

Drive ring 34 (also known as a sprocket, spider, daisy, etc.) is located at end 42 of barrel 30 and is configured to operably couple drum 16 to drum drive 17. Roller ring 36, a circular annular member that fits around the exterior of barrel 30 of drum 16 at a location generally between ends 40 and 42. Roller ring 36 is configured to serve as a surface against which rollers 64 coupled to frame 20 ride as drum 16 rotates. Examples of potential constructions for drive ring 34 and roller ring 36 are found in copending International Patent Application Serial No. PCT/US03/25656 entitled Mixing Drum and filed on Aug. 15, 2003 by Anthony Khouri, William Rogers and Peter Saad, wherein the entire disclosure of this application is hereby incorporated by reference.

Drum drive 17 (also known as drive assembly) is operatively coupled to power source 22 and mixing drum 16. Drum drive 17 transmits power or movement from power source 22 to provide a rotational force or torque to rotate drum 16. An example of one embodiment of the drum drive 17 is disclosed in U.S. Pat. No. 5,820,258 entitled Cement Mixer Drum Support which issued on Oct. 13, 1998, the full disclosure of which is incorporated by reference.

Delivery system 18 generally comprise one or more structures positioned adjacent to end 40 of drum 16 which are configured to receive concrete and aggregate through opening 38 and to deliver the concrete or aggregate to a desired location. Delivery system 18 includes spout 66 and chute 68. Spout 66 funnels concrete into chute 68 which guides the flow of concrete or other aggregate within a channel to a desired location.

Figure 2:
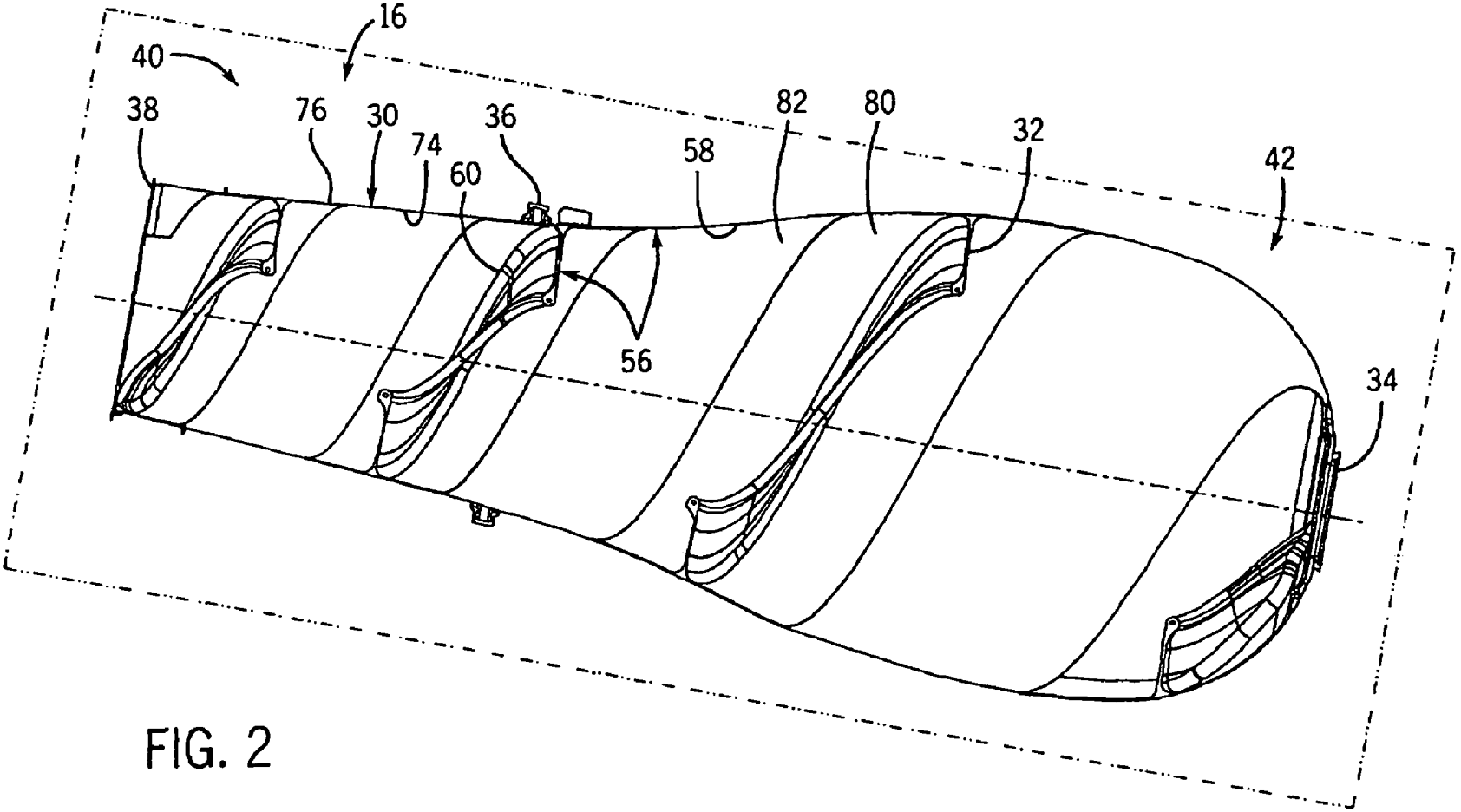
FIG. 2 is a sectional view of the drum of FIG. 1.
Figure 3:
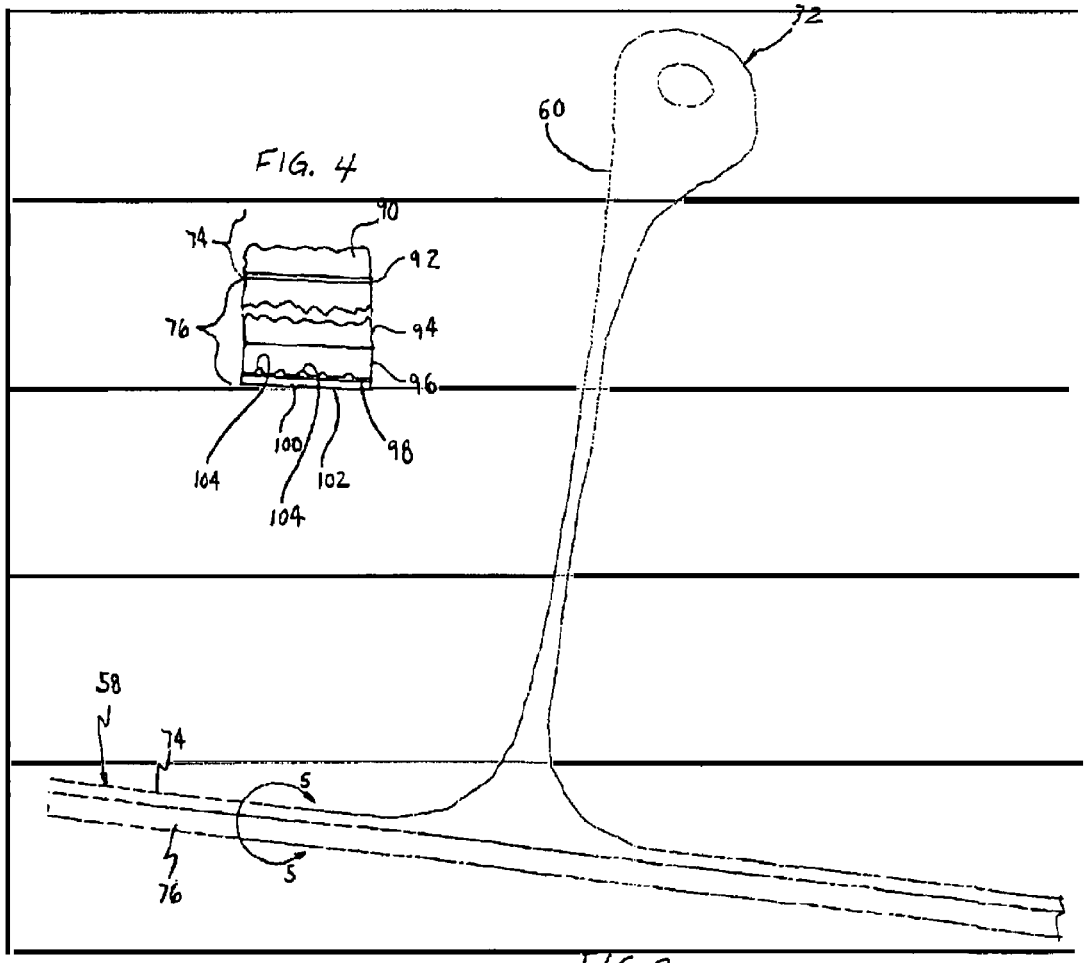
FIG. 3 is an enlarged fragmentary sectional view of a portion of the drum of FIG. 1.
Figure 5:
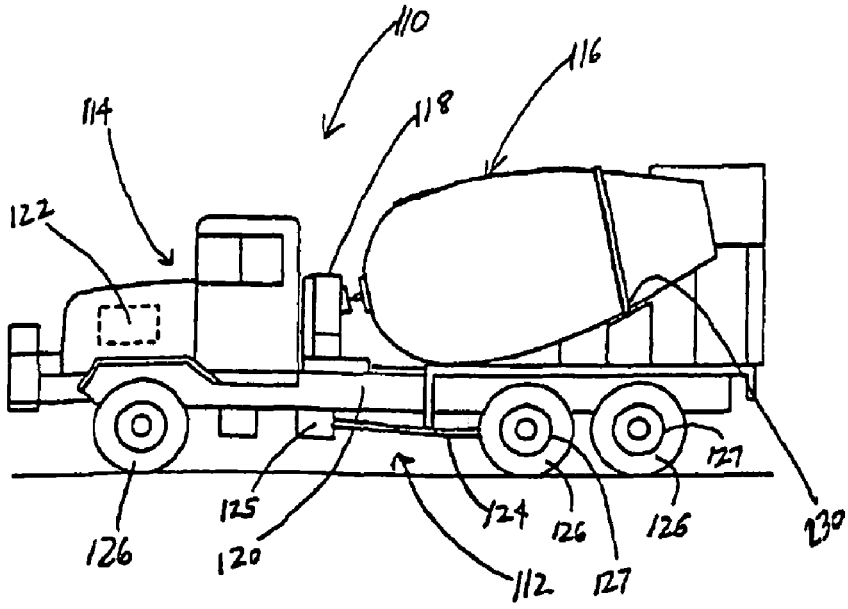
FIG. 5 is a side elevational view of an alternative embodiment of the concrete mixing vehicle of FIG. 1 with another embodiment of a mixing drum.
Figure 6:
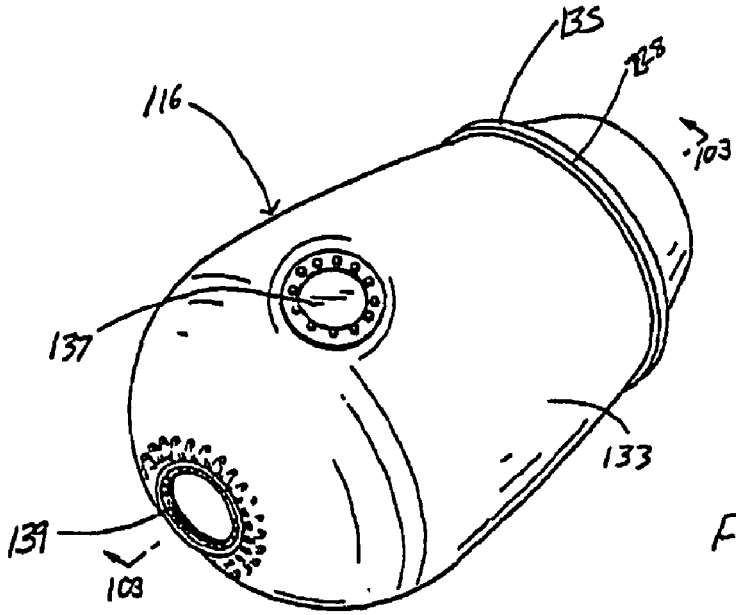
FIG. 6 is a perspective view of the mixing drum of FIG. 5.

FIGS. 2 through 4 illustrate barrel 30 and projections 32 in greater detail. FIG. 2 is sectional view of drum 16. FIG. 3 is an enlarged fragmentary sectional view of drum 30 and projections 32. FIG. 4 is an enlarged fragmentary sectional view of drum 30 of FIG. 3 taken along a line 4-4. In the particular example illustrated in FIGS. 2 through 4, drum 16 is substantially formed from two major layers 74, 76 of material that extend across an axial midpoint of drum 16 and particularly extend from end 40 to end 42. Layers 74 and 76 generally serve to provide the main structure of drum 16. Although not illustrated, additional non-structural layers or coatings may additionally be added. For example, relatively thin paint, decals, coatings or other non-structural layers may be further applied to the exterior of layer 76. For purposes of this disclosure, the use of the term "exterior" with reference to barrel 30 or drum 16 generally refers to the exterior of layer 76 despite the potential presence of additional non-structural layers over top of layer 76, such as decals, paint, coatings or other non-structural layers. Because layers 74 and 76 extend across an axial midpoint of drum 16 and nominally extend from end 40 to end 42, drum 16 has improved structural strength along the axial length between main portion 44 and snout portion 46. In addition, because layers 74 and 76 continuously and integrally extend as unitary bodies from end 40 to end 42, drum 16 lacks seams or joints where sections would otherwise be bolted or fastened together. As a result, drum 16 lacks interior corners where concrete or aggregate may collect, making cleaning easier. At the same time, exterior of drum 16 also lacks surface discontinuities, outwardly projecting flanges (other than roller ring 36), or other abrupt surface contours where concrete and aggregate may collect, further simplifying cleaning of drum 16.

Layer 74 generally comprises a polymer impregnated or infused with a slip agent. For purposes of this disclosure, the term "slip agent" refers to any substance, whether in solid or liquid form that when mixed with a polymer reduces the coefficient of friction of the polymer along its surface as compared to the same polymer without the substance. In one particular embodiment, the slip agent has a surface energy less than the surface tension of a Portland Cement low slump concrete. In another embodiment, the slip agent has a surface energy of less than about 20 dynes per centimeter. In one embodiment, the slip agent is configured so as to not substantially migrate within the polymer. As a result, the slip agent does not migrate to a boundary between layers 74 and 76 which could present lamination issues. In one embodiment, the slip agent is a polydecene. In another embodiment, the slip agent is a polyalpha olefin. In another embodiment, the slip agent is polytetraflourethylene. In other embodiments, other slip agents may be employed.

In one embodiment, the polymer into which the slip agent is impregnated includes polyurethane. According to one exemplary embodiment, the slip agent impregnated into the polyurethane is polytetraflourethylene. The polytetraflourethylene comprises a powder. Because the polytetraflourethylene is a solid, it is held firmly in place within the polyurethane matrix. The polytetraflourethylene is at least 2% by weight of the impregnated polyurethane. In particular, it has been found that impregnating the polyurethane with at least 2% by weight of the polytetraflourethylene reduces the adhesion of concrete and other aggregate material to interior surfaces 56 of drum 16. In the exemplary embodiment, the polytetraflourethylene has a percentage by weight of less than 5% of the impregnated polyurethane. As a result, the impregnated polytetraflourethylene does not significantly impact or weaken the polyurethane. In particular embodiments where physical strength of the impregnated polymer are not required, the polytetraflourethylene may have a greater percentage by weight of the impregnated polyurethane.

According to one exemplary embodiment, the polytetraflourethylene comprises a Teflon powder sold under the mark Zonyl MP-1600 by Dupont. Zonyl MP-1600N is a fluoroadditive in the form of a powder which can be used at temperatures from 190 to 250° C. Zonyl MP-1600N is inert to nearly all industrial chemicals and solvents. It is a good electrical insulator, does not absorb water and is highly resistant to weathering. Zonyl MP-1600 has a melting peak temperature of approximately 325° C. (ASTMD 4894), a particle size distribution (volume basis) having an average of 12 micrometers (measured by Laser Microtrack), and have a specific surface area of 812 $M^2/G$ (tested by nitrogen adsorption) (meets ASTMD D5675, Type I, Grade 3, Class A). In other embodiments, other polytetraflourethylenes with other particle sizes or in other forms may be employed.

According to one embodiment, the polytetraflourethylene powder is dispersed into a polyol using high sheer mixing with a Cowles blade. In one embodiment, the polytetraflourethylene powder is mixed with the polyol prior to the addition of a prepolymer and a plasticizer, Benzoflex. This process results in polytetraflourethylene powder being finely disbursed throughout the polymer (polyurethane) matrix. Because the polytetraflourethylene powder is mixed with the polyol prior to addition of the prepolymer or Benzoflex, the mixture has a lower surface tension which reduces the amount of surface air on the polytetraflourethylene powder and reduces air bubbles formed by coalescence of the air during the polyol/prepolymer reaction. Reducing the number of air bubbles in the impregnated polymer increased the strength of the impregnated polymer (impregnated polyurethane).

According to another embodiment, the slip agent comprises a polyalpha olefin sold under the mark SYNTON oil by Crompton Corporation. SYNTON oil is a polydecene. In particular, SYNTON oil is SYNTON PA0 100. SYNTON PA0 100 has a kinematic viscosity at 100° C. of 100, a specific gravity (20/20° C.) of 0.847, a flash point, degrees Celsius, ASTMD-92 of 301, a fire point degrees Celsius, ASTMD-92 of 327 and a pour point, degrees Celsius, ASTMD-97 of −24.

In the embodiments in which the polyalpha olefin fluid is impregnated into polyurethane and has a percentage by weight of between 2 and 5 percent, the coefficient of friction of interior surfaces 56 will be reduced by approximately 55%. Due to its highly branched structure, migration of the polyalpha olefin fluid within the polyurethane matrix is relatively slow. As a result, the fluid does not significantly migrate towards layer 76. In one particular embodiment, the polyalpha olefin fluid has a percent by weight of at least 1% of the impregnated polymer (polyurethane). As a result, concrete adherence to surface 56 is light. In another embodiment, the polyalpha olefin fluid has a percent by weight of at least 2% of the impregnated polymer, resulting in the impregnated polymer having imperceptible concrete adherence to surface 56. In one embodiment, the polyalpha olefin fluid has a percent by weight no greater than 5% of the impregnated polymer. As a result, the physical properties of the polyurethane are not substantially affected. In particular applications, the polyalpha olefin fluid may have a greater percent by weight of the impregnated polymer where required physical properties of the polymer are not as stringent. Polyalpha olefin fluid significantly reduces the coefficient of friction of the polyurethane at levels which do not substantially degrade the physical strength or structural qualities of the polyurethane. In addition, the polyalpha olefin fluid does not entrain air during its impregnation or addition to the polymer. The chart below indicates physical qualities of the impregnated polyurethane (provided by ERA polymers) when impregnated with 1%, 2% and 5% by weight polytetraflourethylene powder (Zonyl MP-1600N) and the impregnated polyurethane when impregnated with a polyalpha olefin fluid (SYNTON oil PA0 100) at levels of 1%, 2% and 5% by weight.

Although particular examples have been provided describing the use of polytetraflourethylene or a polyalpha olefin fluid impregnated into a polymer such as polyurethane, other polymers and other slip agents may alternatively be employed at various relative concentrations depending upon the required physical qualities of the impregnated polymer. Although layer 74 is described as comprising a polymer impregnated with a slip agent to reduce the coefficient of friction and adherence of the resulting material, layer 74 may alternatively be formed by a slip agent, such as polytetraflourethylene, impregnated with a strength or durability agent, wherein the strength or durability agent is in a substance which, when added to the slip agent, increases the strength or durability of the slip agent.

In the particular embodiment illustrated, layer 74 extends along interior surface 58 or barrel 30 as well as exterior surfaces 60 of projections 32. As shown by FIG. 3, in one particular embodiment, layer 74 forms an entire thickness of projection 32 at a radial mid-portion of projection 32. As shown by FIG. 2, layer 74, which provides interior surface 56 of drum 16, is provided by two elongate archimedial or helical sections 80, 82. Each section 80, 82 provides an interior surface 58 of barrel 30 and provides a projection 32. Sections 80 and 82 are spirally wrapped or screwed to one another with their edges extending adjacent or to close proximity with one another.

| | | | PTFE (MP-1600) | | | Synton Oil 100 | | |
|---|---|---|---|---|---|---|---|---|
| Test | Units | Control | 1% | 2% | 5% | 1% | 2% | 5% |
| Hardness Shore A | Shore A | 90.2 | 89.6 | 88.4 | 88.3 | 89.1 | 89 | 89.5 |
| Tensile Strength | MPa | 17.8 | 16.8 | 16.6 | 10.8 | 17.1 | 15.7 | 16.7 |
| Modulus 100% | MPa | 9.7 | 9.4 | 8.7 | 8.3 | 9.1 | 9 | 8.6 |
| Modulus 200% | MPa | 11.1 | 11.1 | 10.4 | 9.4 | 10.9 | 10.6 | 10.3 |
| Modulus 300% | MPa | 12.7 | 12.8 | 12.1 | 10.3 | 12.5 | 12.2 | 12.2 |
| Elongation at Break | % | 546 | 485 | 507 | 338 | 506 | 482 | 491 |
| Tear Strength | kN/m | 75.2 | 72.1 | 68.4 | 65.6 | 72.2 | 70.8 | 69.4 |
| Peel Strength (90 deg/neat) | ppl | 137 | 69 | 62 | 63 | 116 | 113 | 121 |
| Peel Strength (90 deg/split) | ppl | 98 | 67 | 50 | 57 | 74 | 80 | 83 |
| Peel Strength (180 deg/Crtn) | ppl | 92.5 | 91.7 | 88.9 | 88.3 | | | |
| Peel Strength (180 deg/Dex) | N | 178 | 274 | 276 | 135 | 71 | 93 | 102 |
| Seam Strength | N | 1210 | 2273 | 2433 | 2055 | 1579 | 2197 | 2175 |
| NBS Abrasion (Avg. 2 sets) | index | 1061 | 1363 | 1419 | 1196 | 1865 | 1878 | 1569 |
| DIN Abrasion (Avg. 2 sets) | index | 323 | 332 | 311 | 325 | 415 | 386 | 353 |
| COF (Static) | | 0.65 | 0.42 | 0.37 | 0.36 | 0.4 | 0.29 | 0.29 |
| COF (Dynamic) | | 0.72 | 0.45 | 0.38 | 0.34 | 0.38 | 0.35 | 0.5 |
| Texus Flox | cycles (7days/14 days | <500/1360 | <500/4430 | <500/2170 | <500/500 | <500/4770 | <500/3730 | <500/3500 |
| Concrete Adhesion | Qualitative Adhesion | Firmly | Firmly | Lightly | None | Lightly | None | None |

Overall, because layer 74 is formed from a polymer impregnated with a slip agent, layer 74 which forms interior surfaces 56 of drum 16 has a lower coefficient of friction and adheres less to concrete or other aggregate being mixed within drum 16. During mixing of concrete and aggregate, surfaces 56 are normally abraded, forming small grooves and scratches in which concrete forms a mechanical lock and hardens. However, due to its lower coefficient of friction, surface 56 impedes the collection of concrete or other aggregate within such scratches. Moreover, because the slip agent is impregnated or at least partially disbursed throughout the polymer to form layer 74, layer 74 is sufficiently durable so as not wear at an excessive rate as compared to a layer consisting solely of a slip agent such as polytetraflourethylene. In addition, the structural strength of other physical qualities of the polymer are maintained and used in particular embodiments.

After sections 80 and 82 are positioned adjacent to one another, such sections 80 and 82 each extend substantially from end 40 to end 42, layer 76 is formed in a continuous integral fashion from end 40 to end 42 over sections 80 and 82 and across the seams between sections 80 and 82. In one particular embodiment, layer 76 is formed from fiberglass windings which are coated with resin and wrapped or wound over and around layer 74 and sections 80 and 82. In one embodiment, the resin is Hetron 942, available from Ashland Chemical, in Dublin, Ohio, and the fibers are fiberglass, preferably 2400 Tex E glass (approximately 206 yards per pound). The angles at which the fibers are wound about layer 74 at the major axis (location at which barrel 30 as a greatest diameter) is approximately 10.5 degrees relative to the central axis of barrel 30. During the winding process, the resin coated fiber windings are wrapped generally from one end of the drum to the other. The ribbon of the windings is wrapped around the drum such that there is approximately 50% overlap between each pass of the ribbon. The wrapping of the fibers or windings from end to end provide drum 16 with structural support to withstand various forces in various directions. A more detailed discussion of sections 80, 82, projections 32 and the fiberglass windings of layer 76 is provided in copending International Patent Application Serial No. PCT/US03/25656 entitled Mixing Drum, the full disclosure of which is hereby incorporated by reference and copending International Patent Application Serial No. PCT/AU03/00664 filed on May 31, 2003 by Anthony Khouri entitled Vehicle Mounted Concrete Mixing Drum and Method of Manufacture Thereof, wherein the entirety of International Patent Application Serial No. PCT/AU03/00664 is hereby incorporated by reference. Layer 74 of the present application is similar to the interior polymer layer forming the interior surface of the drum and projections described in copending International Patent Application Serial No. PCT/US03/25656 and copending International Patent Application Serial No. PCT/AU03/00664 except that such layer 74 is impregnated with a slip agent.

FIG. 4 is a greatly enlarged fragmentary sectional view of layers 74 and 76 along barrel 30. FIG. 4 illustrates a process for finishing exterior surfaces 48 and 50 of barrel 30 such that the exterior surface of drum 16 is smoother, facilitating improved application of paint, labels, decals or other aesthetic layers upon layer 76 and further facilitating improved cleaning of the exterior of drum 16 by reducing concrete adherence to the exterior of drum 16. As shown by FIG. 4, layer 74 includes the impregnated polymer layer 90 comprising a polymer impregnated with a slip agent (as described above) and a layer 92 of glass reinforced plastic which bonds to layer 90 during the molding of sections 80 and 82. As described in copending International Patent Application PCT/AU03/00664, layer 92 is positioned along the interior of the molds. Thereafter, the liquid polymer (in this case, the liquid impregnated polymer) is injected into the molds wherein the polymer impregnated with the slip agents bonds to layer 92 and is thereafter removed from the mold and mounted to a jig or fixture.

As shown by FIG. 4, layer 76 includes sublayer 94 comprising the resin coated fiberglass windings which are wrapped about layer 74 as described in copending International Patent Application PCT/AU03/00664. However, the outermost exterior surface of layer 94 is generally extremely course, making painting, coating or application of aesthetic decals difficult. As shown by FIG. 4, layer 76 is further finished by applying a sacrificial layer 96 over layer 94, grinding a preliminary exterior surface 98 to a smooth finish and then applying a top layer 100 over surface 98 to provided final exterior surface 102 of layer 76 which is smooth and more susceptible to being painted, to having decals applied to it or to being otherwise coated by additional nonstructural layers.

In one particular embodiment, sacrificial layer 96 comprises chopper fiberglass, including strands of fiberglass having lengths of approximately 2 inches. During its application, the chopper fiberglass forms air pockets. Grinding of layer 96 cuts through the air pockets to expose a plurality of depressions, pinholes or pores 104 along preliminary surface 98. Top layer 100 extends over and across pores 104 to form a smooth bridge over pores 104. Material chosen for top layer 100 has a sufficient stiffness so as to not sag into pores 104 but to alternatively bridge across pores 104. In one particular embodiment, top layer 100 comprises chopper fiberglass. Layer 100 generally has a thickness much less than the thickness of sacrificial layer 96. In one embodiment wherein layers 96 and 100 each comprise chopper fiberglass, layer 96 has a thickness of up to 0.25 inch while top layer 100 has a maximum thickness of 0.05 inch. The resulting finished surface 102 omits pores or pinholes which would otherwise receive concrete, making cleaning of the exterior drum 16 difficult. Moreover, layer 100 further prevents concrete from being deposited in the pinholes where it would otherwise expand and potentially crack the surface of drum 16. In the particular embodiment illustrated, sacrificial layer 96 is ground using an abrasive having at least 16 grits. In one embodiment, sacrificial layer 96 is ground using a 16 grit sanding belt.

Overall, mixing drum 16 is lighter in weight for the volume or aggregate that it can carry as compared to conventional steel front discharge drums. In addition, because snout portion 46 is integrally formed with main portion 44, drum 16 has a barrel 30 that has a continuous and smooth interior surface 58 as well as a continuous and relatively smooth exterior surface 54 transitioning between main portion 44 and snout portion 46. As a result, both the interior and exterior surfaces of barrel 30 of drum 16 lack joints, corners or other surface discontinuities (excluding drive ring 36 and projection 32) where concrete or aggregate can collect and make cleaning difficult. The cleanability of drum 16 is further enhanced by the use of a polymer impregnated with a slip agent to provide interior surface 56 of drum 16. Both the interior surface 58 of barrel 30 as well as the exterior surface 60 of projections 32 are at least partially formed from the impregnated polymer to reduce coefficient of friction and to reduce concrete adherence. At the same time, the impregnated polymer substantially maintains the same physical qualities as compared to the unimpregnated polymer.

The exterior surfaces 48, 50 and 54 are also resistant to concrete adherence and are sufficiently smooth for an improved aesthetic appearance and for facilitating additional aesthetic layers such as paint, coatings or decals to be further applied. In particular, the sacrificial layer 96 fills in and bridges across the larger depressions or valleys along the exterior of layer 94 (provided by resin wetted fiberglass windings). The preliminary exterior surface 98 of sacrificial layer 96 is further ground to a smoother finish. In one particular embodiment in which the sacrificial layer 96 is chopper fiberglass, this results in pinholes or pores 104 along preliminary exterior surface 98. Top layer 100 fills in and bridges over such pinholes or pores to produce a finished surface 102.

In alternative embodiments, layer 76 may be finished with other techniques and/or materials. For example, sacrificial layer 96 may be provided by a material which does not result in the formation of pinholes or pores upon being ground. In such an alternative embodiment, top layer 100 may be omitted. In still another embodiment, sacrificial layer 96 may be omitted where the exterior of layer 94 is ground (i.e., sanded) and where in top layer 100 is applied directly to layer 94. In such an application, layer 94 should preferably have a thickness or a sufficient strength so as to meet the strength requirements of drum 16 after portions of layer 94 are sacrificed.

Drum 16 is illustrated as including a combination of several features which synergistically enhance the performance of drum 16. In other embodiments or applications, these features ma be employed independent of one another or in different combinations. For example, although layer 74 formed from the polymer impregnated with the slip agent (or alternatively the slip agent impregnated with the strength/durability agent) is illustrated as integrally forming both interior surface 58 of barrel 30 and exterior surface 60 of projection 32, in other embodiments, layer 74 may alternatively only form interior surface 58 of barrel 30. In still another embodiment, layer 74 may only form the exterior surface 60 of projections 32. Although layer 74 is illustrated as integrally forming projection 32 with barrel 30, projection 32 alternatively comprise a separately formed structure which is fastened or bonded to barrel 30. In such an alternative application, one or both of interior surface 58 of barrel 30 and exterior surface 60 of projection 32 may still include the impregnated polymer.

Although layer 74 is illustrated as being utilized in a front discharge concrete mixing drum 16, layer 74 with the polymer impregnated with a slip agent may alternatively be employed in a rear discharge drum 116 such as shown in FIGS. 5-8 and described in copending International Patent Application Serial No. PCT/US03/25656. Although layer 74 is illustrated as being utilized in a concrete mixing drum (front discharge or rear discharge) formed from at least two archimedial helical sections which form the interior of the drum, the impregnated polymer may alternatively be used in a drum in which the interior surface 56 of the drum is simultaneously molded. For example, in the mixing drum disclosed in copending International Application Serial No. PCT/AU00/01226 filed on Oct. 9, 2000 by Anthony Khouri and William Rodgers and entitled VEHICLE MOUNTED PLASTICS DRUM FOR CONCRETE MIXING AND METHODS OF MANUFACTURE THEREOF, the full disclosure of which is incorporated by reference, wherein the polymer disclosed as providing the interior surface of the drum (unimpregnated polyurethane) may be replaced with a polymer impregnated with a slip agent such as an impregnated polyurethane.

Although layer 74 formed from the polymer impregnated with a slip agent is described as being utilized in conjunction with a layer exterior to layer 74 which is formed from fiberglass, layer 74 may alternatively be utilized in conjunction with a layer exterior to layer 74 formed from one or more other materials. For example, layer 74 may alternatively be utilized with an additional layer exterior to layer 74 formed from a metal. In lieu of being molded, the polymer impregnated with the slip agent may alternatively be coated upon layer 76. In one embodiment, layer 74 may be coated upon a layer 76 formed from one or more non-metal materials such as fiberglass. In another embodiment, layer 74 may be coated upon layer 76 formed from a metal such as steel.

Although layer 74 is illustrated as continuously extending from end 40 to end 42, layer 74 may alternatively be molded into sections which do not extend from end 40 to end 42 or may be coated or otherwise applied to layer 76 which itself does not continuously extend from end 40 to end 42. For example, layer 76 may alternatively be formed from generally annular sections (but for end 42 which would be closed) formed from a non-metal material such as fiberglass or a metal material such as steel, which are bonded or fastened to one another. In such an application, layer 74 may be coated upon the annular sections, such as by spraying, either after the sections are assembled together or before the sections are assembled together or may be fastened to the sections after the sections are fastened together or before the sections are fastened together. In one embodiment, layer 74 may be formed as a section and may be fastened to layer 76 which is in sections so as to overlap or bridge across the seams between the sections of layer 76 along the interior of the drum for improved strength. As mentioned above, in those applications wherein the structural requirements of layer 74 are less stringent, such as when layer 74 is coated or sprayed to an existing drum, the amount or percentage of slip agent impregnated into the polymer may be increased.

Although projection 32 is illustrated as having the shape and configuration shown in FIGS. 2 through 3, projection 32 and alternatively have other configurations and may be formed by other techniques. For example, projection 32 may alternatively be configured and formed as shown in copending U.S. patent application Ser. No. 10/049,605, the full disclosure which is hereby incorporated by reference. In still other embodiments, projection 32 may be formed from other materials and other processes.

Although the finishing process described with respect to FIG. 4 is illustrated in conjunction with finishing the exterior of barrel 30 of drum 16, this finishing process may also be utilized in other drums having an exterior surface (prior to painting, decals and the like) that is provided by fiberglass or other materials which result in a relatively rough textured surface. For example, the finishing process may also be utilized to finish the exterior surface of the drum formed according to copending U.S. patent application Ser. No. 10/049,605, the full disclosure of which is hereby incorporated by reference. Although the entire exterior surface of barrel 30 of drum 16 is described as being finished according to the process discussed with respect to FIG. 4, this finishing process may alternatively be formed along only selected areas of the surface of barrel 30.

FIGS. 5-8 illustrate a concrete mixing truck 110 having a front discharge drum 116 having an inner drum layer 134 which includes an impregnated slip agent such as a polydecene or a polyalpha olefin fluid or a polytetraflourethylene. Concrete mixing truck 110 includes a chassis 112, a cab region 114, a mixing drum 116, and a mixing drum drivetrain 118. Chassis 112 includes a frame 120, a power source 122, a drivetrain 124, and wheels 126. Frame 120 provides a mixing truck 110 with the structural support and rigidity needed to carry heavy loads of concrete. Power source 122 is coupled to frame 120 and generally comprises a source of rotational mechanical energy which is derived from a stored energy source. Examples include, but are not limited to, an internal combustion gas-powered engine, a diesel engine, turbines, fuel cell driven motors, an electric motor or any other type of motor capable of providing mechanical energy.

Drivetrain 124 is coupled between power source 122 and wheels 126 and transfers power (or movement) from power source 122 to wheels 126 to propel truck 110 in a forward or rearward direction. Drivetrain 124 includes a transmission 125 and a wheel end reduction unit 127. Both transmission 125 and wheel end reduction unit 127 utilize a series or set of gears to adjust the torque transmitted by power source 122 to wheels 126. One example of a wheel end reduction unit is described in copending U.S. patent application Ser. No. 09/635,579, filed on Aug. 9, 2000, by Brian K. Anderson entitled NON-CONTACT SPRING GUIDE, the full disclosure of which is hereby incorporated by reference.

Cab region 114 is coupled to chassis 112 and includes an enclosed area from which an operator of truck 110 drives and controls at least some of the various functions of truck 110.

Drive assembly or drivetrain 118 is operatively coupled to power source 122 and mixing drum 116 and uses the power or movement from power source 122 to provide a rotational force or torque to mixing drum 116. According to an alternative embodiment, the drivetrain may be powered by a source other than power source 122 that is provided on truck 110.

Figure 7:
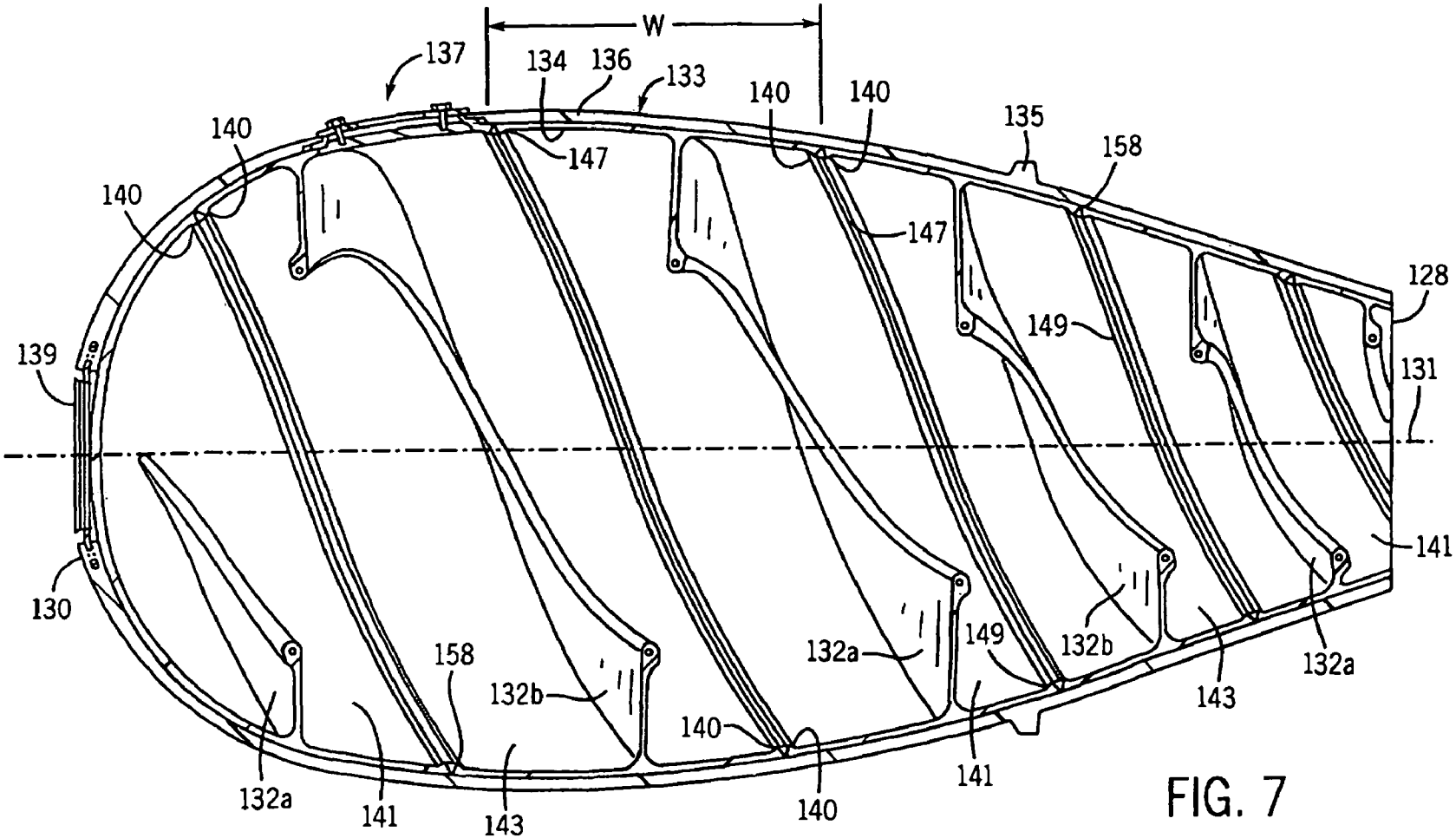
FIG. 7 is a sectional view of the drum of FIG. 5 taken along line 7-7.

Referring now to FIG. 7, mixing drum 116 includes a barrel 133, projections 132, ramps 140, a hatch cover assembly 137 or 300, a drive ring 139, and a roller ring 135. Barrel 133 is a generally teardrop- or pear-shaped container that has an opening 128 on one end (the smaller end) and a drive ring 139 (described below) coupled to the other larger end 130 or barrel 133. Barrel 133 includes an inner drum layer 134 and an outer drum layer 136. Inner drum layer 134 is made up of two spiral-shaped sections 141 and 143 that are "screwed" or mated together. Each of sections 141 and 143 is a substantially flat panel that is formed in the shape of a spiral around an axis that becomes a central axis 131 of barrel 133 when sections 141 and 143 are completely assembled. Each of sections 141 and 143 has a width W that extends substantially parallel to axis 131 of barrel 133 (or that extends generally along the length of central axis) and a length that substantially circumscribes or encircles the axis 131. According to one exemplary embodiment, the width of each section varies along the length of each section, for example from between approximately 6 inches and 36 inches. Each of the sections 141 and 143 has a first edge 147 that extends the length of the section and a second edge 149 that extends the length of the section. Each of sections 141 and 143 is spiraled around the axis 131 of barrel 133 such that there is a gap between the first edge 147 of the section and the second edge 149 of the same section. This gap provides the space that will be filled by the other section when it is mated or screwed to the first section. Accordingly, when the sections 141 and 143 are assembled together to form inner drum layer 134, edge 147 of section 141 will abut edge 149 of section 143 and edge 149 of section 141 will abut edge 147 of section 143. A seam 158 is formed where the edges of sections 141 and 143 abut one another.

Once the two sections of the inner drum layer 134 have been assembled, outer drum layer 136 is formed as a continuous layer around the outer surface of the inner drum layer 134. Accordingly, outer drum layer 134 extends continuously from one end of the barrel to the other and spans the seams between sections 141 and 143. Outer drum layer 136 is a structural layer that is made from a fiber reinforced composite material applied by winding resin coated fibers around the outer surface of inner drum layer 134. According to one embodiment, the resin is Hetron 942, available from Ashland Chemical, in Dublin, Ohio, and the fibers are fiberglass, preferably 2400 Tex E Glass (approximately 206 yards/lb). According to one embodiment, the angle at which the fibers are wound around the drum at the major axis (the location at which barrel 133 has the greatest diameter) is approximately 10.5 degrees relative to axis 131 of the barrel 133. During the winding process, the resin coated fibers are wrapped generally from one end of the drum to the other. According to one embodiment, the fibers are provide in a ribbon or bundle that is approximately 250 millimeter wide and includes 64 strands. The ribbon of fibers is wrapped around the drum such that there is approximately 50% overlap between each pass of the ribbon. The wrapping the fibers from end to end, helps to provide drum 116 with the structural support to withstand the various forces that are applied to drum 116 in a variety of different directions.

According to an exemplary embodiment, projections 132 and ramps 140 are integrally formed a single unitary body with sections 141 and 143. Each of sections 141 and 143, and the corresponding projections and ramps, are formed through an injection molding process from polyurethane impregnated with a slip agent, and outer drum layer 136 is made using fiberglass fibers coated with a resin. According to other alternative embodiments, the inner drum layer and/or the outer drum layer may be made from any one or more of a variety of different materials including but not limited to polymers, elastomers, rubbers, ceramics, metals, composites, etc. According to still other alternative embodiments, other processes or components may be used to construct the drum. For example, according to various alternative embodiments, the inner drum layer may be formed as a single unitary body, or from any number of separate pieces, components, or sections. According to other alternative embodiments, the inner drum layer, or any of sections making up part of the inner drum layer, may be made using other methods or techniques. According to still other alternative embodiments, the outer drum layer may be applied over the inner drum layer using any one or more of a number of different methods or techniques.

Referring still to FIG. 7, projections 132*a* and 132*b* are coupled to sections 141 and 143, respectively, and extend inwardly toward central axis 131 of barrel 133 and along the length of the respective section. Accordingly, two substantially identical projections 132*a* and 132*b* are coupled to inner drum layer 134 and spiral around the inner surface of inner drum layer 134 in the shape of an archimedian spiral. In one embodiment, projection 132*a* and 132*b* extend from an axial end of barrel 133 across an arial midpoint of barrel 133. Projections 132*a* and 132*b* are circumferentially spaced apart around axis 131 by approximately 180 degrees. Because projections 132*a* and 132*b* are substantially identical, further references to the projections will simply refer to "projection 132" when discussing either (or both of) projection 132*a* and 132*b*.

A projection and one or more ramps are coupled to each section of inner drum layer 134. Because the projection and ramp(s) that are coupled to each section include substantially identical features and elements, where appropriate, the projection and ramps that are coupled to one section will be described, it being understood that the projection and ramps of the other section are substantially identical. FIG. 4 illustrates projection 132 and ramps 140*a* and 140*b*, which are coupled to section 141, in greater detail.

Projection 132 (e.g., fin, blade, vane, screw, formation, etc.) includes a base portion 142, an intermediate portion 144, and end portion 146. Base portion 142 extends inwardly from section 141 toward the axis of drum 116 and serves as a transitional area between section 141 and intermediate portion 144 of projection 132. Such a transitional area is beneficial in that it tends to reduce stress concentrations in base portion 142 that may result from the application of force to projections 132 by the concrete. The reduction of the stress concentrations tends to reduce the likelihood that projection 132 will fail due to fatigue. To provide the transitional area, base portion 142 is radiused or tapered on each side of projection 132 to provide a gradual transition from section 141 to intermediate portion 144. To minimize any unwanted accumulation of set concrete, the radius is preferably greater than 10 millimeters. According to one exemplary embodiment, the radius is approximately 50 millimeters. According to another embodiment, the radius begins on each side of projection 132 proximate section 141 approximately three inches from the centerline of projection 132 and ends approximately five inches up the height H of projection 132, proximate intermediate region 144 of projection 132. Because drum 116 rotates, the orientation of any particular section of projection 132 constantly changes. Accordingly, to simplify the description of projection 132, the term "height," when used in reference to projection 132, will refer to the distance projection 132 extends inwardly toward the center axis of drum 116, measured from the center of base portion proximate section 141 to the tip of end portion 146. It should be noted, however, that the height of projection 132 changes along the length of projection 132. Consequently, the locations at which the radius or taper begins and/or ends, or the distance over which the radius or taper extends, may vary depending on the height and/or location of any particular portion of the projection. According to various alternative embodiments, the radius of the base region may be constant or it may vary. According to other alternative embodiments, the transition between the section and the intermediate portion of the projection may be beveled or may take the form of some other gradual transition. Moreover, the locations at which the transition or taper may begin or end may vary depending on the material used, the thickness of the inner drum wall, the height of the projection, the loads that will be placed on the projection, the location of a particular portion of the projection within the drum, and a variety of other factors.

According to any exemplary embodiment, the characteristics of the taper should be such that the projection is allowed to at least partially flex under the loads applied by the concrete. However, if the taper is such that it allows the projection to flex too much, the projection may quickly fatigue. One the other hand, if the taper is such that it does not allow the projection to flex enough, the force of the concrete on the projection may pry on inner drum layer 134 and potentially tear inner drum layer away from outer drum layer 136.

Intermediate portion 144 of projection 132 extends between base portion 142 and end portion 146. According to one embodiment, intermediate portion 144 has a thickness of approximately six millimeters and is designed to flex when force from the concrete is applied thereto.

End portion 146 of projection 132 extends from intermediate portion 144 toward the axis of drum 116 and includes a support member 148 and spacers 150. The thickness of end portion 146 is generally greater than the thickness of intermediate portion 144. Depending on where along the length of projection 132 a particular section of end portion 146 is provided, the added thickness of end portion 146 may be centered over intermediate portion 144 to offset to one side or the other. In some areas along the length of projection 132, end portion 146 is provided on only one side of intermediate portion 144 (e.g., the side closest to opening 128 or the side closest to end 130). In such a configuration, end portion 146 acts as a lip or flange that extends over one side of intermediate portion 144 and serves to improve the ability of projection 132 to move or mix concrete that comes into contact with the side of intermediate portion 144 over which end portion 146 extends. Due to the increased thickness of end portion 146 in relation to intermediate portion 144, end portion 146 includes a transitional region 145 that provides a gradual transition from intermediate portion 144 to end portion 146. According to an exemplary embodiment, the transitional region is radiused. According to alternative embodiments, the transitional region may be beveled or tapered. To minimize any wear or accumulation that may occur as a result of concrete passing over end portion 146, projection 132 terminates in a rounded edge 152.

According to various alternative embodiments, each of the base region, the intermediate region, and the end region may be different sizes, shapes, thicknesses, lengths, etc. depending on the particular situation or circumstances in which the drum will be used.

Figure 8:
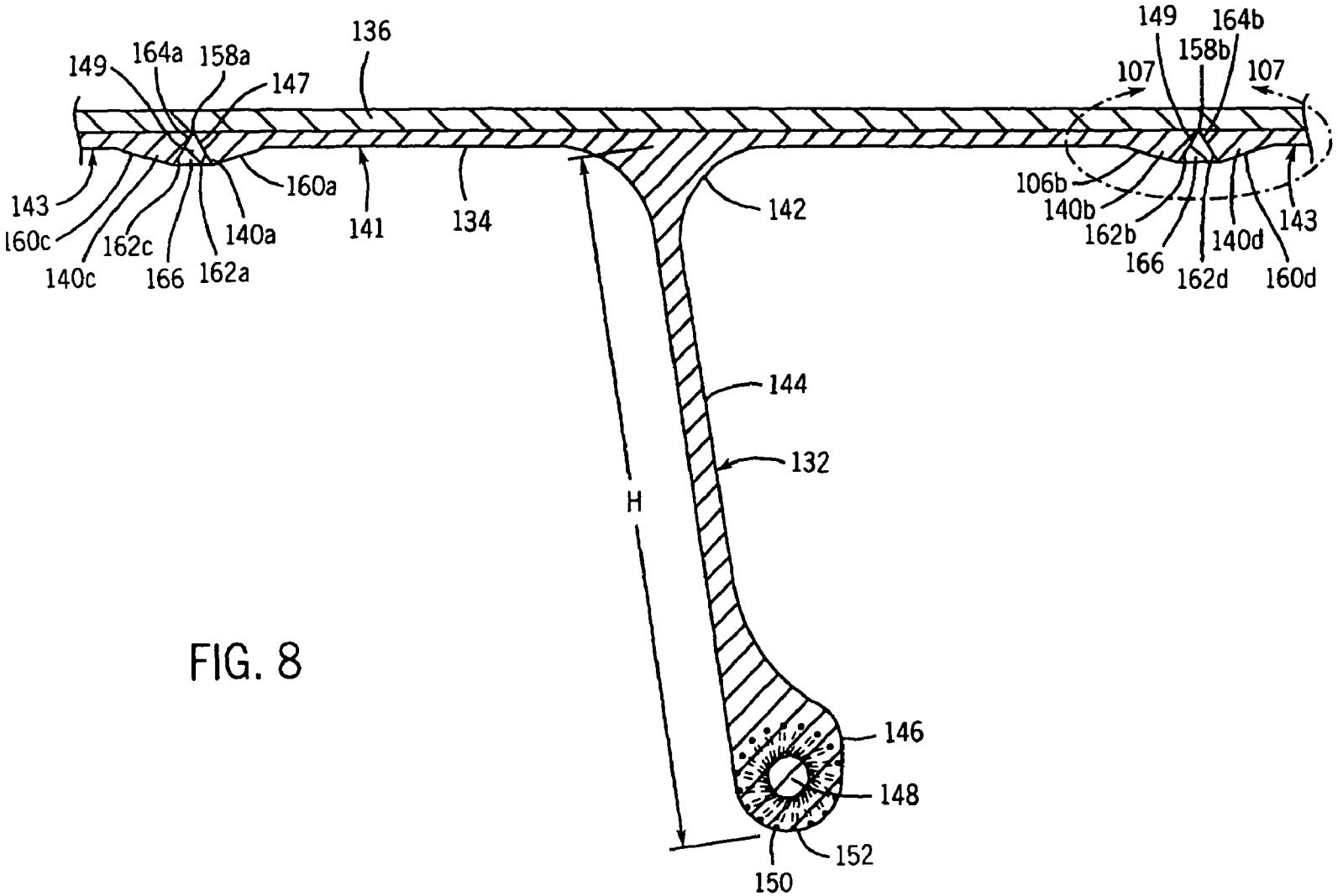
FIG. 8 is a partial sectional view of the drum of FIG. 5.

FIG. 8 illustrates support member 148 in greater detail. As shown in FIG. 8 support member or torsion bar 148 is an elongated circular rod or beam that is embedded within end portion 146 of projection 132 to provide structural support to projection 132. Torsion bar 148 has a shape that corresponds to the spiral-like shape of projection 132 and extends the entire length of projection 132. The ends of bar 148 have flared fibers that are embedded in inner dram layer 134. Torsion bar 148 serves to substantially restrict the ability of end portion 146 of projection 132 to flex when a load is applied to projection 132 by the concrete, an thereby prevents projection 132 from essentially being folded or bent over by the concrete. Although sufficiently rigid to support projection 132, torsion bar 148 is preferably torsionally flexible. The torsional flexibility of torsion bar 148 allows it to withstand torsional loads that result from some deflection of end portion 146 of projection 132. According to one exemplary embodiment, support member 148 is a composite material that is made primarily of carbon or graphite fibers and a urethane-based resin. According to one exemplary embodiment, the ratio of carbon fibers to the urethane-base resin is 11 pounds of carbon fiber to 9 pounds of urethane-based resin. One example of such a urethane-based resin is Erapol EXP 02-320, available from Era Polymers Pty Ltd in Australia. According to alternative embodiments, the support member may be made from any combination of materials that allows the support member to provide the desired structural support yet at the same time allows the torsion bar to withstand the torsional loads that may be applied to the torsion bar. For example, the torsion bar may be made from one or more of fiberglass fibers and ester-based resins. According to other alternative embodiments, the size and shape of the support member may vary depending on the particular circumstances in which the support member will be used.

According to an exemplary embodiment, support member 148 is made through a pulltrusion process. The pulltrustion process includes the steps of collecting a bundle of fibers, passing the fibers through a bath of resin, and then pulling the resin coated fibers through a tube. The support member 148 is then wrapped around an appropriately shaped mandrel and allowed to cure to give support member 148 the desired shape. The fibers are pulled through the tube by a cable of a winch that is passed through the tube and coupled to the fibers. To facilitate the coupling of the cable to the fibers, the fibers are doubled over and the cable is attached to the loop created by the doubled over fibers. The winch pulls the cable back through the tube, which, in turn, pulls the fibers through the tube. According to one exemplary embodiment, the urethane-based resin through which the fibers are passed before entering the tube is injected into the tube at various points along the length of the tube as the fibers are being pulled through the tube. According to alternative embodiments, the support member may be made by any one or more of a variety of different processes.

According to one exemplary embodiment, projection 132 and ramps 140 are integrally formed with each of sections 141 and 143 as a single unitary body and are made along with sections 141 and 143. As described above, each of sections 141 and 143, and the corresponding projection 132 and ramps 140, are preferably made through an injection molding process during which an elastomer is injected between molds. In order to embed support member 148 within end portion 146 of projection 132, support member 148 is placed in a mold that defines the shape of projection 32 prior to the injection of the elastomer. To keep support member 148 in the proper location within the mold during the injection process, spacers, shown as helical springs 150, are wrapped around the circumference of support member 148 and spaced intermittently along the length of support member 148. Each spring 150 is retained around the circumference of support member 148 by connecting one end of spring 150 to the other. When support member 148 and springs 150 are placed in the mold prior to the injection process, springs 150 contact an inside surface of mold 154 and thereby retain support member 148 in the proper location within the mold.

When the elastomer is injected into the molds, the elastomer flows through spring 150 and surrounds (e.g., embodies, encapsulates, etc.) each of its coils. As a result, there is a continuous flow of the elastomer through spring 150, such that if the elastomer does not securely bond to the coils of sprints 150, the areas along projection 132 where springs 150 are placed are not significantly weaker than the areas along projection 132 where there are no spring spacers 150. According to various alternative embodiments, other materials and structures may be used as spacers. For example, the spacer may be made from any one or more of a variety of materials including polymers, elastomers, metals, ceramics, wood, etc. The spacer may also be any one of a variety of different shapes and configurations, including but not limited to, circular, rectangular, triangular, or any other shape. Moreover, the spacer may not substantially surround the support member, but rather may include one or more members that are provided intermittently around the periphery of the support member. According to other alternative embodiments, the spacer may be a flat disc or a cylinder having an outside diameter that contacts the inside surface of the mold and an aperture through which the support member passes. The flat disc or cylinder also may include a plurality of apertures extending therethrough to allow for the continuous flow of the injected elastomer through at least some areas of the disc.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single; particular element also encompass a plurality of such particular elements.

What is claimed is:

1. A rotary concrete mixing drum comprising:

a first helical wall element having a first ramp formation and a second helical wall element having a second ramp formation, the second helical wall element joined to the first helical wall element along a helical seam with the first and second ramp formations disposed adjacent to the seam, the first helical wall element and the second helical wall element forming a substantially continuous common wall having an interior surface circumferentially extending about a longitudinal axis to form an interior of the drum;

the interior surface at least partially provided by a polymer infused with a slip agent;

wherein the polymer includes polyurethane, and the slip agent is a polytetraflourethylene powder configured to be held firmly in place so as not to substantially migrate within the polymer and having a weight percentage of at least 2% and no greater than 5% of the infused polymer along the surface, or a polyalpha olefin fluid having a branched structure configured so as not to significantly migrate within the polymer and having a weight percentage of at least 2% and no greater than 5% of the infused polymer along the surface.

2. The drum of claim 1 wherein the slip agent has a surface energy less than the surface tension of a Portland Cement low slump concrete.

3. The drum of claim 1 wherein the slip agent has a surface energy of less about 20 dynes per centimeter.

4. The drum of claim 1 including: an inner layer comprising the infused polymer along the inner surface; and an outer layer providing an exterior surface of the drum.

5. The drum of claim 4 wherein the outer layer is non-metallic.

6. The drum of claim 5 wherein the outer layer includes fiberglass.

7. The drum of claim 6 wherein the fiberglass comprises a first layer of chopper fiberglass, the first layer having a ground surface with pores; and a second layer of chopper fiberglass over the first layer and across the pores.

8. The drum of claim 7 wherein the first layer has a first thickness and wherein the second layer has a second thickness, the second thickness being less than the first thickness.

9. The drum of claim 8 wherein the first thickness is about 0.25 inch and wherein the second thickness is about 0.05 inch.

10. The drum of claim 8 wherein the second layer has a thickness of about 0.1 inch.

11. The drum of claim 7 wherein the ground surface has a smoothness from being ground by a 16 grit abrasive.

12. The drum of claim 4 wherein the outer layer comprises fiberglass windings, and a sacrificial layer over the fiberglass windings, wherein the sacrificial layer has a surface having pores, and a top layer over the sacrificial layer and across the pores.

13. The drum of claim 4 wherein the outer layer is metallic.

14. The drum of claim 1 wherein the impregnated polymer has a tensile strength of at least 15 MPa.

15. The drum of claim 1 wherein the impregnated polymer has a Modulus 300% of at least 12 MPa.

16. The drum of claim 1 wherein the impregnated polymer has a tear strength of at least 68 kN/m.

17. The drum of claim 1 further comprising inwardly extending projections configured to move material as the drum is rotated, wherein the projections partially provide the interior surface of the drum.

18. The drum of claim 17, wherein the projections have an exterior surface including the infused polymer.

19. The drum of claim 18, wherein at least a portion of one of the projections has a thickness completely formed from the infused polymer.

* * * * *